United States Patent [19]

Johnson

[11] 4,268,206

[45] May 19, 1981

[54] ARTICLE TREATING MACHINE

[75] Inventor: Charles M. Johnson, Terryville, Conn.

[73] Assignee: Napco, Inc., Terryville, Conn.

[21] Appl. No.: 71,109

[22] Filed: Aug. 30, 1979

[51] Int. Cl.[3] ..... B65H 49/02; B65H 15/00

[52] U.S. Cl. ..... 414/222; 198/342; 198/344; 118/416

[58] Field of Search ..... 198/342, 344, 345, 378, 198/680; 134/76, 757; 414/222, 225, 911; 118/416, 425, 426; 74/829

[56] References Cited

U.S. PATENT DOCUMENTS

| | | | |
|---|---|---|---|
| 1,867,389 | 7/1932 | Sylvester | 198/431 |
| 2,975,882 | 3/1961 | Abbey | 198/342 |
| 3,362,520 | 1/1968 | Rudolph et al. | 198/378 |
| 3,637,062 | 1/1972 | Barton | 198/342 |

*Primary Examiner*—Robert B. Reeves
*Assistant Examiner*—Brian Bond
*Attorney, Agent, or Firm*—McCormick, Paulding & Huber

[57] ABSTRACT

An automatic electroplating machine has a plurality of plating barrels supported by cantilever arms on an elevator-conveyor for intermittent movement along a continuous, generally horizontal path to and through a plurality of work stations. Groups of barrels are lowered into and lifted out of a series of treating tanks located at work stations and along a rectilinear portion of the conveyor path. When the barrels are in lowered positions pinions on some of the barrels are engaged with reciprocally movable rack assemblies which oscillate the barrels in unison about horizontal axes and within the associated treating tanks.

13 Claims, 9 Drawing Figures

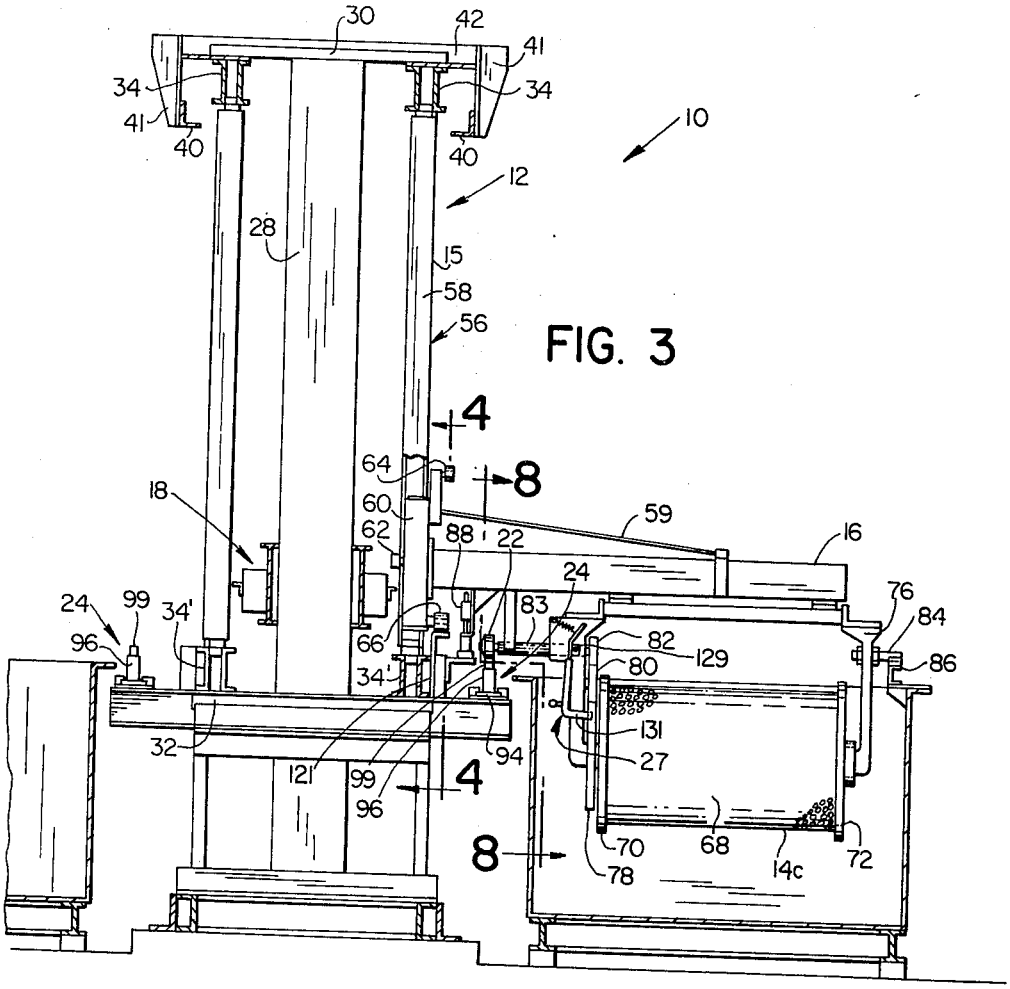
FIG. 3
FIG. 4
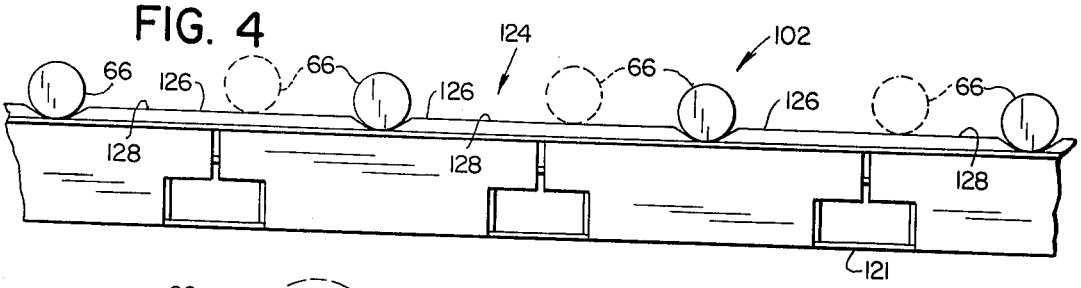
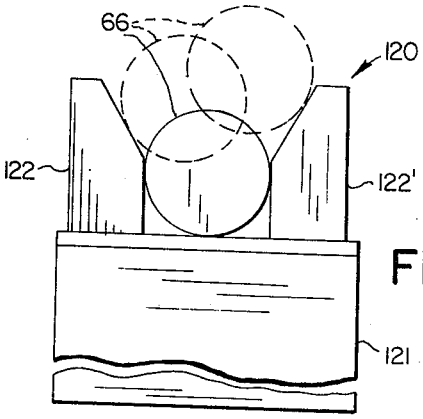
FIG. 5

FIG. 7
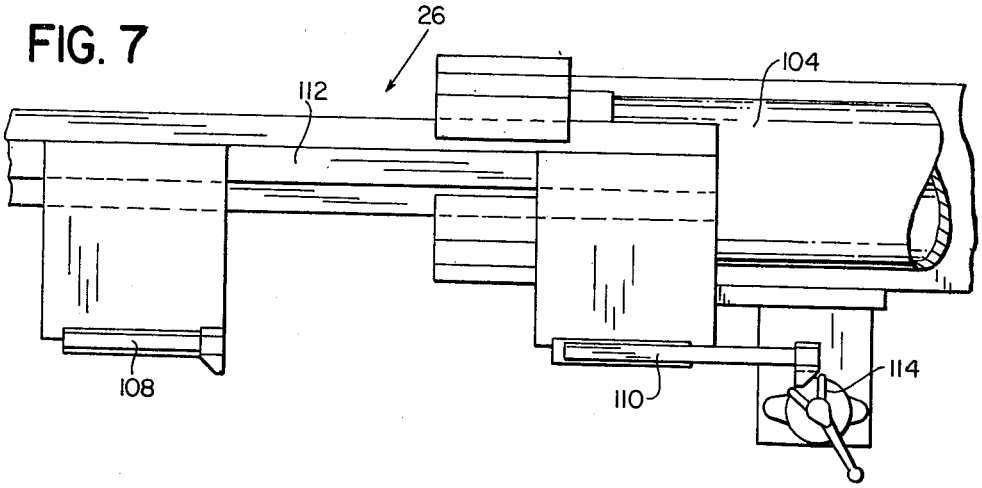
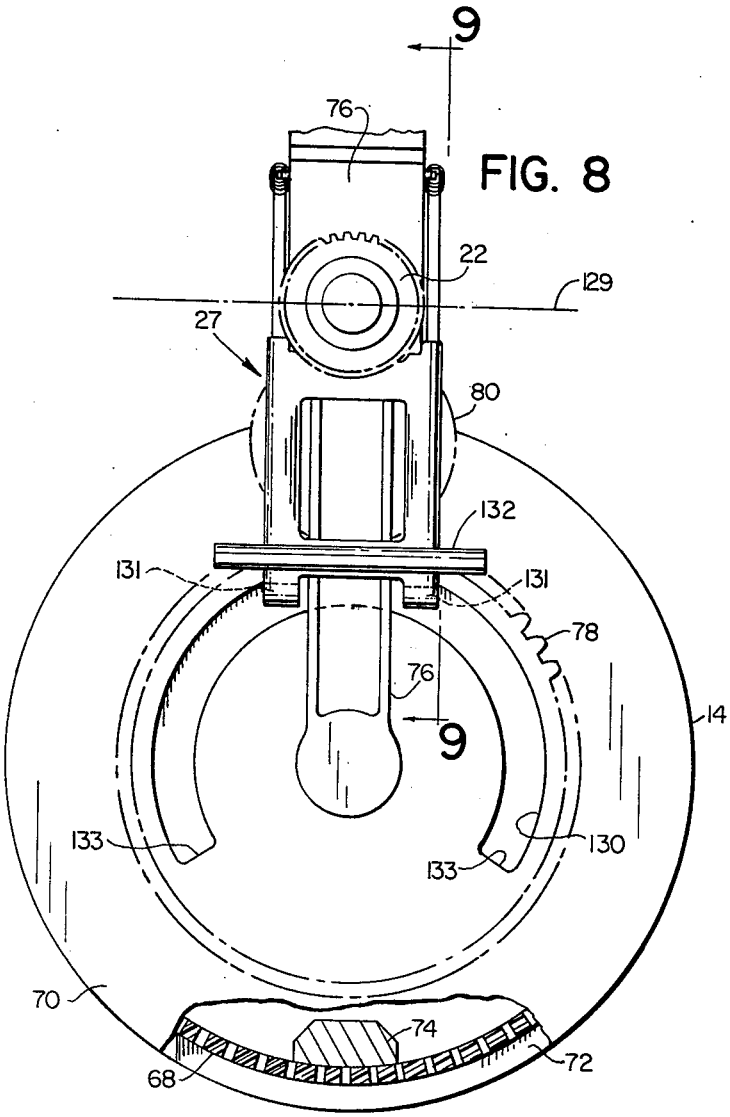
FIG. 8
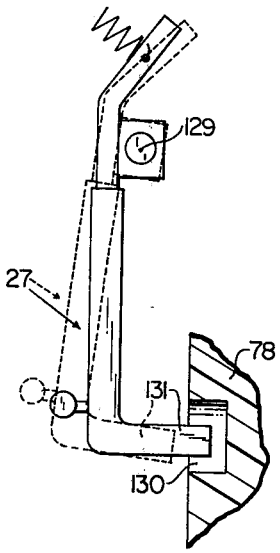
FIG. 9

ARTICLE TREATING MACHINE

BACKGROUND OF THE INVENTION

This invention relates in general to apparatus for treating articles and deals more particularly with an improved return type automatic machine for electroplating, anodizing or cleaning articles of manufacture. A machine of the aforedescribed general type usually has an elevator-conveyor system which includes a plurality of arms supported in cantilever position for intermittent movement to work stations positioned along a continuous or endless path and for vertical movement relative to a series of treating tanks located along the path. Racks which support small articles to be treated and carried by the arms are moved into and out of the treating tanks by an elevator mechanism which comprises part of the elevator-conveyor system whereby the racked articles are successively moved from a loading and unloading station to and through a succession of work stations and returned to the loading and unloading station where the racks are automatically or manually handled. Such an automatic return type machine is well suited for treating articles which may be economically, individually handled. However, such machines as heretofore available lack the capability of treating articles in bulk. Accordingly, it is the general aim of the present invention to provide an improved automatic return type machine capable of plating, anodizing or cleaning small work pieces in bulk which cannot be otherwise economically handled.

SUMMARY OF THE INVENTION

In accordance with the present invention an improved article treating machine is provided which has an intermittently operable elevator-conveyor system including a conveyor having a plurality of carrier arms supported in horizontal cantilever position for generally horizontal movement along a continuous path. The machine further includes a plurality of barrels carried by the arms, a plurality of treatment tanks arranged in horizontal series at work stations along a rectilinear segment of the path, and elevator means for lowering and raising the arms at various work stations. Each barrel is supported by a bracket on an associated one of the arms for rotation about a horizontal axis. Pinion means mounted for rotation with each of the barrels are engageable with a rack assembly supported for reciprocal movement along a path parallel to the rectilinear segment when the barrels are lowered into the tanks by the elevator mechanism. A drive mechanism is provided for reciprocating the rack assembly to oscillate each of the barrels about its axis and within an associated tank.

BRIEF DESCRIPTION OF THE DRAWINGS

FIG. 3 is a sectional view taken along the line 3—3 of FIG. 1.

FIG. 4 is a somewhat enlarged fragmentary sectional view taken along the line 4—4 of FIG. 3 and shows the cam mechanism associated with a multiple station tank.

FIG. 5 is a fragmentary sectional view similar to FIG. 4, but shows the cam mechanism associated with a single station tank.

FIG. 7 is a somewhat enlarged fragmentary plan view of the oscillating drive mechanism shown in FIG. 6.

FIG. 8 is a somewhat enlarged fragmentary sectional view taken generally along the line 8—8 of FIG. 3.

FIG. 9 is a fragmentary sectional view taken generally along the line 9—9 of FIG. 8.

DETAILED DESCRIPTION OF PREFERRED EMBODIMENT

Figure 1:
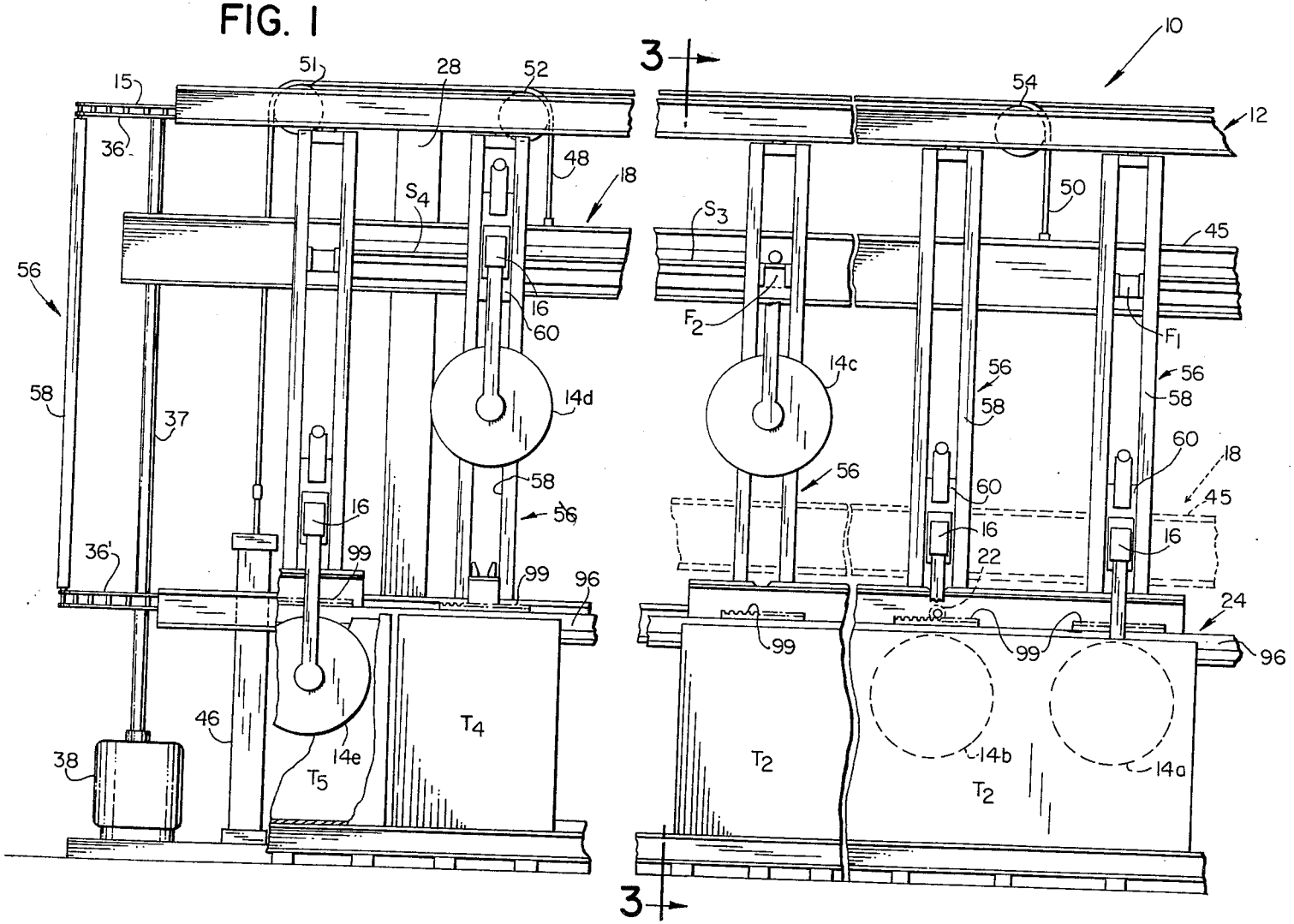
FIG. 1 is a fragmentary side elevational view of a machine embodying the present invention.
Figure 2:
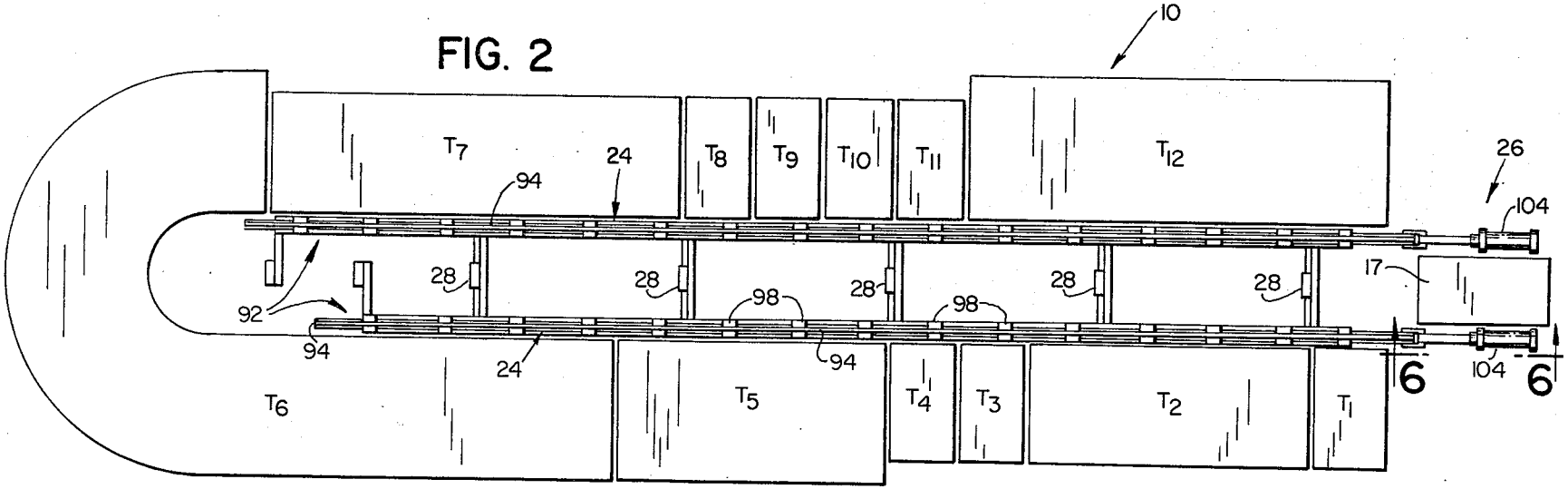
FIG. 2 is a somewhat reduced fragmentary sectional view of the machine of FIG. 1 taken generally along the line 2—2 of FIG. 1.

Turning now to the drawings and referring first particularly to FIGS. 1-3, an article treating machine for electroplating or anodizing metal or plastic articles, for example, and embodying the present invention is indicated generally by the reference numeral 10. The illustrated apparatus 10 is an automatic return type machine and has an elevator-conveyor system, indicated generally at 12, which includes a conveyor 15 which intermittently moves a plurality of plating barrels 14, 14, designated more particularly at **14*a*–14*e* in FIG. 1, in a continuous path from a loading and unloading station, indicated by the numeral 17 in FIG. 2, to and through a series of work stations and returns the barrels to the loading and unloading station 17. Each plating barrel 14 is supported by an associated carrier arm 16, best shown in FIG. 3, which comprises a part of the conveyor 15. An elevator mechanism, indicated generally at 18, and which also comprises a part of the system 12, lowers and raises, in unison, groups of carrier arms 16, 16 to move certain of the plating barrels carried by the arms into and out of a series of treating tanks at work treatment stations located along the conveyor path. When the plating barrels are in lowered or immersed positions within certain of the treating tanks, pinions 22, 22 connected in driving relation with the various plating barrels are engaged with an associated rack assembly, indicated generally at 24, located along a rectilinear portion of the conveyor path. An oscillating mechanism, designated generally by the numeral 26, and best shown in FIGS. 6 and 7, reciprocates the rack assembly 24 to oscillate an associated group of plating barrels 14, 14 in unison about horizontal axes at the various work treating stations and within the treatment tanks. An oscillation limiting device 27, associated with each plating barrel 14, and shown in FIGS. 3 and 8**, limits barrel rotation about its axis at all times except when it is being loaded or unloaded.

Various arrangements of treating tanks and loading and unloading stations may be used in practicing the invention. The illustrated machine 10 has treating tanks indicated at $T_1$–$T_{12}$ and shown in FIG. 2. The tanks $T_1$–$T_5$ and $T_7$–$T_{12}$ are arranged in parallel spaced apart rows at opposite sides of the machine substantially as shown in FIG. 2. The tank $T_6$ has a curved portion at one end of the machine and extends from one to the other side of the machine. Tanks $T_2$, $T_5$, $T_6$, $T_7$ and $T_{12}$ are multiple station tanks adapted to simultaneously receive a plurality of plating barrels at associated work treating stations therein. The remaining tanks $T_1$, $T_3$, $T_4$ and $T_8$–$T_{11}$ are single station tanks and are each adapted to receive a single plating barrel 14.

The conveyor 15 is of a carrousel type and has a frame which includes a plurality of vertical columns 28, 28 arranged in longitudinally spaced apart series in the space between the two rows of treating tanks, as best shown in FIG. 2. Each column 28 carries upper and lower cross beams indicated at 30 and 32, respectively, and best shown in FIG. 3. Two pair of parallel chain guide rails 34, 34 are mounted on the upper cross beams 30, 30 at opposite sides of the columns 28, 28. Two pair of similar chain guide rails 34', 34' are mounted on the lower cross beams 32, 32 in vertical alignment with the upper chain guide rails 34, 34. Upper and lower endless chains 36 and 36' (FIG. 1) are supported by sprockets at opposite ends of the machine and travel between the upper and lower chain guide rails 34 and 34' respectively. A drive shaft 37 connected to the upper and lower sprockets at one end of the machine is coupled to a drive motor 38 which intermittently drives the conveyor 15. The system 12 further includes horizontally disposed storage tracks 40, 40 supported on brackets 41, 41 which depend from the outboard ends of a plurality of cross members 42, 42 mounted at longitudinal intervals on the upper chain guide rails 34, 34 as best shown in FIG. 3. By-pass tracks (not shown) may also be provided for maintaining plating barrels 14, 14 in elevated postion to by-pass certain of the treatment tanks, as desired, and in a manner known in the art.

The elevator mechanism 18 includes a pair of longitudinally extending elevator beams, 45, 45 located at opposite sides of the columns 28, 28 and connected together for movement in unison between raised and lowered positions respectively indicated by full and broken lines in FIG. 1. The beams carry elevator track sections associated with the single station tanks $T_1$, $T_3$, $T_4$, $T_8$, $T_9$, $T_{10}$ and $T_{11}$. Track section $S_3$ and $S_4$ which are typical, are shown in FIG. 1. Each multiple station tank has one movable track portion or flipper $F_1$ in vertical alignment with the work treatment station at its upstream end and another movable track portion or flipper $F_2$ in vertical alignment with the work treatment station at its downstream end. Each flipper is movable between a raised or barrel carrying portion and a lowered or inactive position, and is or may be cammed to the aforesaid positions in response to movement of the elevator mechanism, in a manner well known in the art and as will be hereinafter further discussed. The elevator beams 45, 45 are connected to an hydraulic cylinder 46 by a pair of chains 48 and 50 supported on overhead sprockets 51, 52 and 54. The hydraulic cylinder 46 is arranged to exert a downwardly directed pulling force on the chains 48 and 50 to cause a corresponding upward movement of the elevator beams 45, 45 and the various elevator track sections.

Each carrier arm 16 comprises a part of an associated carrier assembly. A typical carrier assembly, indicated generally at 56, and best shown in FIGS. 1 and 3, includes a vertical channel 58 defined by vertical guide rails connected to and extending between the upper and lower drive chains 36 and 36'. A slide block 60 supported for vertical sliding movement within the channel 58 has an associated carrier arm 16 mounted in cantilever position thereon. The arm 16 is further supported by a tie-rod 59, substantially as shown in FIG. 3. A roller follower 62 is mounted on the inboard side of the slide block 60 for engagement with the various elevator track sections, such as the illustrated sections $S_3$ and $S_4$. Another roller follower 64 is mounted on the outboard side of the slide block 60 at a somewhat higher elevation than the roller follower 62 for selective engagement with the storage track 44 or a by-pass track (not shown). A third roller follower 66 is mounted on the outboard side of the slide block below the follower 64, for a purpose which will be hereinafter further described.

A typical plating barrel 14, best shown in FIGS. 3 and 8, is made from plastic and has a generally cylindrical body 68 and circular end walls 70 and 72. The body 68 is perforate and has a slot shaped opening at its upper end which extends between the end walls. A rib 74 within the body 68, and shown in FIG. 8, extends across the bottom of the barrel between the end walls 70 and 72. The illustrated barrel 14 is supported for rotation about a generally horizontal axis by a mounting bracket assembly 76 secured to the carrier arm 16. The barrel 14 is driven by a gear 78 mounted in fixed position on the end wall 70 and engaged with a gear train which includes an idler gear 80 and a drive gear 82. The drive gear is mounted on a drive shaft 83 journalled on the bracket 76 and on the arm 16, substantially as shown in FIG. 3. The pinion 22 is mounted on the inboard end of the drive shaft 83 and is connected to the drive shaft by an integral override clutch, for a reason which will be hereinafter further evident. A lug 84 projects outwardly from the outboard end of the mounting bracket 76 and is arranged to engage a saddle 86 mounted on the outboard lip of an associated treatment tank when the carrier arm 16 is in its lowered position. An electrical current collector shoe 88 electrically connected to a cathode within the barrel 14 is spring biased in a downward direction to establish electrical contact with a contact bar mounted in fixed position inboard of and relative to each row of treatment tanks, as shown in FIG. 3, and in a manner well known in the art.

Figure 6:
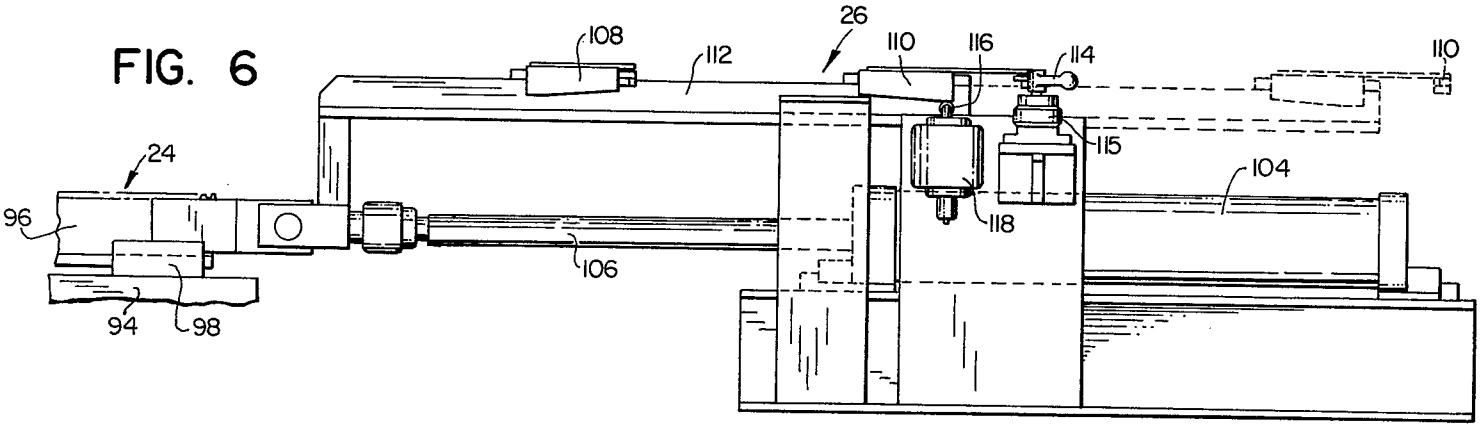
FIG. 6 is a somewhat enlarged fragmentary sectional view taken along the line 6—6 of FIG. 2 and shows the oscillating drive mechanism.

The machine 10 has a pair of longitudinally elongated rack assemblies 24, 24 each mounted inboard of an associated group of treating tanks. Each rack assembly includes an elongated horizontally extending support member 94 mounted in fixed position on cross members secured to the columns 28, 28, as best shown in FIG. 3. A horizontally elongated rack carrier 96 is supported for reciprocal sliding movement in a longitudinal direction on each support member 94 by a longitudinally spaced series of bearing slides 98, 98, as best shown in FIG. 6. Each rack carrier has a longitudinal series of rack segments 99, 99 mounted on its upper surface, as shown in FIG. 1.

Each rack assembly 24 is driven by an associated motor or hydraulic cylinder 104 which has a piston rod 106 and which comprises the oscillating mechanism 26. The cylinders 104, 104 are mounted in fixed position at one end of the machine 10 and at opposite sides of the machine. Each piston rod 106 extends in the direction of an associated rack assembly 24 and has its free end pinned to an end of an associated rack carrier 96. Each cylinder 104 has a pair of cams 108 and 110 mounted on a carrier 112 which travels with its piston rod 106. The cams 108 and 110 cooperate with an associated valve actuator 114 on a fluid control valve 115 to reverse the direction of piston travel and, consequently, the direction of rack carrier movement. The cams 108 and 110 have inclined surfaces which engage a roller follower 116 to operate another fluid control valve 118. The cams 108 and 110 operate the control valve 118 to gradually accelerate the movement of the rack carriers at the beginning of each piston stroke and to decelerate the movement of the rack carriers at the end of each stroke. The cams 108 and 110 may be adjustably positioned relative to the carriers 112, 112 to vary the length of stroke of each rack carrier.

The machine 10 also has a camming mechanism 102 which includes two types of cam assemblies which cooperate with the various roller followers 66, 66. One type of cam assembly shown in FIG. 5, and indicated generally by the reference numeral 120, includes a pair of longitudinally spaced apart cam blocks 122, 122' mounted in fixed position inboard of each of the single station tanks $T_1$, $T_3$, $T_4$ and $T_8$–$T_{11}$ in transverse alignment with the saddles 86, 86 on the various tanks. The cam assemblies 120, 120 are carried by longitudinally elongated cam mounting brackets 121, 121 secured in fixed position on the lower chain guides 34', 34', as shown in FIG. 3.

The cam assemblies associated with multiple station tanks $T_2$, $T_5$, $T_6$, $T_7$ and $T_{12}$ are shown in FIG. 4 and indicated generally by the reference numerals 124, 124. The cam assemblies 124 each comprise longitudinal series of horizontally elongated cam members 126, 126 supported on the upper surface of the cam mounting bracket. The ends of adjacent cam members 126, 126 cooperate to define generally V-shaped upwardly opening grooves at the various treating stations for receiving roller followers 66, 66. Each cam also defines a generally upwardly facing horizontally disposed cam surface 128 which extends between adjacent grooves in vertical alignment with the path of roller followers 66, 66.

In the illustrated embodiment of the invention the oscillation limiting device 27 comprises a fork for limiting the degree of oscillation of each barrel 14 while the barrel is in its raised position and while it is being moved from one work station to next station by the conveyor system. The limit fork 27 is pivoted intermediate its ends on the mounting bracket 76 for pivotal movement about a horizontal axis indicated at 129 in FIG. 8 and has horizontally projecting tines 131, 131 on its lower end which are normally spring biased into an arcuate recess 130 in an associated gear 78. Each time 131 engages an abutment surface 133 at an associated opposite end of the recess 130 to limit barrel oscillation in one direction. A cross bar 132 at the lower end of the limit fork cooperates with a cam (not shown) at the loading and unloading station 17 to cam the limit fork 27 to a releasing position wherein its tines are disposed outside of the arcuate recess 130. A rack assembly may be provided at the loading and unloading station for engaging the pinion 20 to rotate the barrel 14 about its axis and to an inverted or dumping position and for returning the barrel to its load receiving position.

At the beginning of the treating cycle the elevator mechanism 18 is in its lowered or broken line position of FIG. 1, each of the barrels is in an immersed on-station position within an associated one of the treating tanks and the various pinions 22, 22 are in intermeshing engagement with associated rack segments 99, 99. The current collector shoes 88, 88 are in contact with respectively associated contact bars. The oscillating mechanism 26 now operates to axially oscillate the various barrels. The cams 108 and 110 mounted on the carrier 112 cooperates with the fluid control valve 115 and the fluid control valve 118 to control the oscillation of the rack assemblies 92, 92 as hereinbefore discussed. When the elevator 18 is in its lowered position the flippers $F_1$, $F_1$ at the upstream or entry end of the various multiple station tanks, typified by the tanks $T_2$ and $T_5$ in FIG. 1, are in inactive position, having been previously cammed to the latter position by downward movement of the elevator mechanism 18. However, the flippers $F_2$, $F_2$ at the upstream or entry ends of the various multiple station tanks are in raised or barrel carrying position. It should be further noted that there are no elevator track sections associated with the intermediate treating stations of the various multiple station tanks.

At the end of the oscillating cycle the elevator mechanism 18 moves to its raised position. In FIG. 1 the position of various barrels, indicated at **14*a*–14*e*, are shown immediately after the elevator has moved from its lowered to its raised position. When the elevator mechanism 18 moves to its raised position the barrels at the entry ends of the various multiple station tanks, as illustrated by typical barrels 14*a* and 14*e*, remain in lowered or immersed position within the tanks, because the flippers $F_1$, $F_1$ associated with these barrels are in inactive position. However, the flippers $F_2$, $F_2$ associated with the barrels at the exit ends of the various multiple station tanks are in carrying position which cause the barrels at these treating stations to be lifted out of their respective tanks, as illustrated by the typical barrel 14*c* at the exit end of the tank $T_2$. Since there are no elevator track sections associated with the intermediate stations of the various multiple station tanks the barrels at these intermediate stations are not lifted by the upwardly moving elevator mechanism, but remain immersed within their respective ranks. However, each barrel associated with a single station tank, such as the barrel 14*d* associated with tank $T_5$, is lifted from its respective tank by its associated elevator track section by the upward movement of the elevator mechanism 18. The upward movement of the elevator mechanism 18** also resets each of the flippers $F_1$, $F_1$ in its barrel carrying position.

After the elevator mechanism 18 is in its raised position the conveyor 15 operates to advance each of the barrels to the next successive treatment station. Thus, with particular reference to the tank $T_2$ as shown in FIG. 1, the conveyor 15 moves the barrel **14*a* to the next successive station within the tank, that is the position formerly occupied by barrel 14*b*. One of the barrels simultaneously moves within the barrel $T_2$ to the treatment station at the exit or downstream end of the tank, to occupy the position formerly occupied by elevated barrel 14*c*. Movement of the various immersed barrels within the multiple station tanks, as illustrated by the tank $T_2$, is controlled, in part, by the camming mechanism 124, best shown in FIGS. 1 and 4. As the conveyor 15 moves each barrel off-station a roller follower 66 associated with the barrel moves from its on-station position within the V-shaped groove up one of the inclined surfaces of the groove and onto the upwardly facing horizontal cam surface 126, as indicated by the broken line positions of the roller followers 66, 66, shown in FIG. 4. Thus, as each barrel moves to an off-station position the camming mechanism 124 lifts it through a distance sufficient to disengage the pinion 22 carried by the barrel from an associated rack segment. When the barrel has advanced to the next successive treating station its roller follower 66 rollers into the groove at the station to accurately locate the barrel on-station and to cause engagement of the pinion carried by the barrel with the rack segment at the new station location. As previously noted, the cam mechanism 120 shown in FIG. 5 merely functions to locate each barrel on-station with respect to a single station treatment tank, such as the tank $T_4$ shown in FIG. 1**, when the barrel is lowered into the treatment tank by the elevator mechanism.

The oscillating limiting device 27 limits rotational movement of each barrel about its axis while it is moved by the conveyor 15 and also prevents the rack mechanism from imparting excessive angular movement to the barrel after the barrel is positioned on-station. As previously indicated each pinion 22 is connected to its associated drive shaft 83 by an integral override clutch. This clutch coupling arrangement provides for lost motion between each pinion 22 and its associated barrel 14 in the event that the barrel is at one or the other of its limits of rotation, as controlled by the limit fork 27, when the pinion associated with the barrel engages an associated rack segment.

The machine 10 preferably includes automatic controls which may be adjusted or programed to provide a desired treatment cycle. Such control systems are well known in the art.

I claim:

1. In an article treating machine having a series of article treating tanks defining a succession of article treating stations therein, and an elevator-conveyor system including a plurality of arms for carrying articles to be treated, guide rails supporting the arms in general horizontal cantilever position for vertical reciprocal movement between raised and lowered positions, an elevator mechanism for raising and lowering the arms associated with at least some of the treating stations to move articles carried thereby into and out of the tanks defining the latter treating stations, a conveyor operable to intermittently advance the guide rails and the arms carried thereby along an endless path having at least one rectilinear segment to convey the articles to be treated to the various treating stations, a plurality of barrels, bracket means for supporting each of the barrels on an associated one of the arms for rotation about a generally horizontal axis, a plurality of pinions equal in number to the barrels, means drivingly connecting each pinion to an associated one of the barrels, and rack means supported for rectilinear reciprocating movement along a path parallel to said rectilinear segment for engaging said pinions of associated barrels when said associated barrels are in said lowered positions, the improvement comprising oscillating means for reciprocating said rack means including a drive motor having a stationary part and a movable part operably connected to said rack means to move said rack means with a reciprocating stroke and to rotate the pinions engaged with said rack means whereby to axially oscillate said associated barrels and means for controlling said drive motor to gradually accelerate said rack means at the beginning of each stroke and gradually decelerating said rack means at the end of each stroke.

2. In an article treating machine as set forth in claim 1 the further improvement wherein said rack means comprises a horizontally elongated rack support mounted in fixed position relative to said tanks and in parallel alignment with said one segment, a horizontally elongated rack carrier supported for reciprocal sliding movement on said rack support and in parallel relation to said one rectilinear segment, and a longitudinal series of rack segments mounted on said rack carrier, each of said rack segments being transversely aligned with an associated one of said article treating stations.

3. In an article treating machine as set forth in either claim 1 or claim 2 the further improvement wherein said drive motor comprises a fluid motor and said movable part has a reciprocating stroke.

4. In an article treating machine as set forth in claim 3 the further improvement wherein the oscillating means includes means for varying the length of said stroke.

5. In an article treating machine as set forth in claim 4 the further improvement wherein said movable part comprises a piston rod and said means for varying the length of said stroke includes a fluid control valve, a carrier mounted on said piston rod, and cam means mounted on said carrier for operating said fluid control valve to reverse the direction of fluid flow through said fluid motor.

6. In an article treating machine as set forth in claim 5 the further improvement wherein said means for controlling said fluid motor comprises said cam means and another fluid control valve operably connected to said fluid motor and having a follower in the path of said cam means.

7. In an article treating machine as set forth in claim 3 the further improvement wherein said oscillating means includes means for gradually accelerating said movable part at the beginning of each stroke and for gradually decelerating said movable part at the end of each stroke.

8. In an article treating machine as set forth in claim 3 the further improvement wherein said controlling means comprises cam means movable with said rack means and a fluid control valve operably connected to said fluid motor and having a follower disposed in the path of said cam means for operating said control valve.

9. In an article treating machine as set forth in claim 8 the further improvement wherein said cam means comprises a plurality of cams carried by said movable part.

10. In an article treating machine as set forth in claim 1 the further improvement comprising an oscillation limiting means associated with each barrel for limiting barrel rotation about its axis at all times except when said barrel is being loaded or unloaded.

11. In an article treating machine as set forth in claim 10 the further improvement wherein said oscillating limiting means comprises a limit fork pivotally supported intermediate its ends on each mounting bracket and having spaced apart tines normally biased into an arcuate recess defined by a portion of an associated barrel carried by said mounting bracket.

12. An article treating machine having a series of article treating tanks defining a succession of article treating stations therein, and an elevator-conveyor system including guide rails defining vertical channels, a plurality of blocks, each of said blocks supported for vertical movement within an associated one of said vertical channels, a plurality of roller followers, each of said roller followers journalled on an associated one of said blocks, a plurality of arms for carrying articles to be treated, each of said arms supported on an associated one of said blocks in general horizontal cantilever position for vertical reciprocal movement between raised and lowered positions, an elevator mechanism for raising and lowering said arms associated with at least some of said treating stations to move articles carried thereby into and out of the tanks defining the latter treating stations, and a conveyor operable to intermittently advance said guide rails and said arms carried thereby along an endless path having at least one rectilinear segment to convey the articles to be treated to the various treating stations, a plurality of barrels, bracket means for supporting each of said barrels on an associated one of said arms for rotation about a generally horizontal axis, a plurality of pinions equal in number to said barrels, means drivingly connecting each pinion to an associated one of said barrels, rack means supported for rectilinear reciprocating movement along a path parallel to said rectilinear segment for engaging said pinions of associated barrels when said associated barrels are in said lowered positions, oscillating means for reciprocating said rack means to rotate the pinions engaged with said rack means whereby to axially oscillate said associated barrels, and camming means for disengaging said pinions of said associated barrels from said rack means when said associated barrels are in lowered position and are moved off station by said conveyor, said camming means including a longitudinal series of horizontally elongated cam members defining horizontally disposed cam surfaces extending between at least some of said treating stations and defining generally V-shaped upwardly opening grooves transversely adjacent at least some of the treating stations, said roller followers being engageable with said cam surfaces.

13. In an article treating machine having a series of article treating tanks defining a succession of article treating stations therein, and an elevator-conveyor system including a plurality of arms for carrying articles to be treated, guide rails supporting the arms in general horizontal cantilever position for vertical reciprocal movement between raised and lowered positions, an elevator mechanism for raising and lowering the arms associated with at least some of the treating stations to move articles carried thereby into and out of the tanks defining the latter treating stations, and a conveyor operable to intermittently advance the guide rails and the arms carried thereby along an endless path having at least one rectilinear segment to convey the articles to be treated to the various treating stations, a plurality of barrels, bracket means for supporting each of the barrels on an associated one of the arms for rotation about a generally horizontal axis, a plurality of pinions equal in number to said barrels, means drivingly connecting each pinion to an associated one of the barrels, rack means supported for rectilinear reciprocating movement along a path parallel to said rectilinear segment for engaging said pinions of associated barrels when said associated barrels are in said lowered positions, and oscillating means for reciprocating the rack means to rotate the pinions engaged with the rack means whereby to axially oscillate the associated barrels, the improvement comprising oscillation limiting means associated with each barrel for limiting barrel rotation about its axis at all times except when said barrel is being loaded or unloaded and including a limit fork pivotally supported intermediate its ends on each mounting bracket and having spaced apart tines normally biased into an arcuate recess defined by a portion of an associated barrel carried by said mounting bracket.

* * * * *